United States Patent [19]

Nomura

[11] Patent Number: 4,483,464

[45] Date of Patent: Nov. 20, 1984

[54] CONTAINER WITH A POURING SPOUT

[75] Inventor: Toshiaki Nomura, Takatsuki, Japan

[73] Assignee: Toppan Printing Co., Ltd., Tokyo, Japan

[21] Appl. No.: 377,848

[22] Filed: May 13, 1982

Related U.S. Application Data

[63] Continuation of Ser. No. 197,603, Oct. 16, 1980, abandoned.

[51] Int. Cl.[3] ..... B67B 7/26

[52] U.S. Cl. ..... 222/83; 222/89

[58] Field of Search ..... 222/81, 83, 83.5, 89–91, 222/541, 566, 572, 326–327; 220/465; 150/8

[56] References Cited

U.S. PATENT DOCUMENTS

| | | | |
|---|---|---|---|
| 1,165,229 | 12/1915 | Davis | 222/83.5 |
| 2,142,293 | 1/1939 | Waite | 222/90 |
| 2,198,564 | 4/1940 | Robison | 222/83.5 X |
| 3,642,047 | 2/1972 | Waage | 222/83 X |
| 3,924,777 | 12/1975 | Peyser | 222/81 X |
| 3,968,872 | 7/1976 | Cavazza | 222/83 X |
| 4,011,968 | 3/1977 | McGhie et al. | 222/107 |
| 4,214,675 | 7/1980 | Schmit | 222/83 |

FOREIGN PATENT DOCUMENTS

| | | | |
|---|---|---|---|
| 624657 | 1/1963 | Belgium | 222/83 |
| 1041179 | 10/1953 | France | 222/81 |
| 152462 | 5/1932 | Switzerland | 222/83 |
| 577917 | 7/1976 | Switzerland | 150/8 |

*Primary Examiner*—Charles A. Marmor

*Attorney, Agent, or Firm*—Lerner, David, Littenberg Krumholz & Mentlik

[57] ABSTRACT

This invention provides a container with a pouring spout comprising a container body in which is bored a hole of a desired size and the inner surface of which is coated with a thermoadhesive plastic film or an aluminum foil laminated with such a film; a pouring spout body having an inner spout with a pouring channel and an air inlet, said inner spout being tightly but slidably inserted in the inner wall of the pouring spout body, the pouring spout body being adhered over the hole with a flange portion provided outside the lower end thereof so as to communicate with the hole; and a cap placed over the upper end of the pouring spout body. The pouring spout has a blade for tearing the film adhered over the hole in the container body is provided at the lower edge of the inner spout.

8 Claims, 7 Drawing Figures

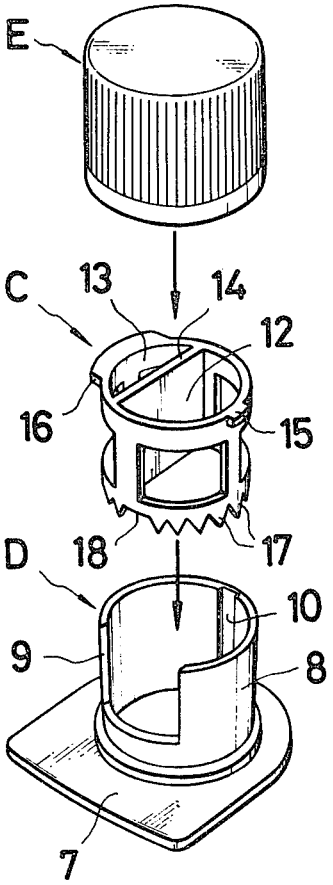
FIG.3
FIG.4
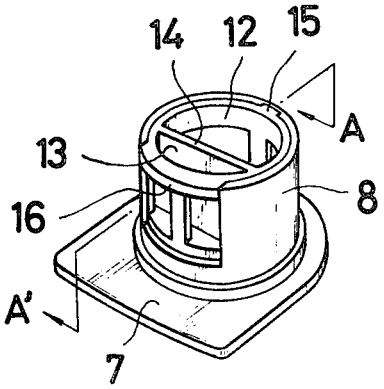

CONTAINER WITH A POURING SPOUT

This is a continuation of application Ser. No. 197,603, filed Oct. 16, 1980, now abandoned.

SUMMARY OF THE INVENTION

It is an object of the present invention to provide a container with a pouring spout suitable for use as a paper container or the like for holding liquid, for example, a gable-top type or flat-top type parallelopiped paper container having an inner surface coated with a thermoadhesive plastic film; or as a generally used liquid container made of plastic or the like having an opening sealed with a thin plastic film which can be easily opened and resealed and from which the contents can be smoothly poured out.

The present invention was devised to achieve the above-mentioned object and provides a paper container with a pouring spout which is characterized in the following respects. The container has a hole of an appropriate size and the inner surface of the container is coated with a thermoadhesive plastic film. A thermoadhesive plastic film or an aluminum foil laminated with a thermoadhesive plastic film is adhered over the hole. A pouring spout body is provided with an inner spout having a pouring channel and an air inlet. The inner spout is tightly inserted but axially slidable inside the inner wall of the pouring spout body. The pouring spout body is adhered over said hole with a flange portion provided outside the lower end thereof so as to communicate with the hole. A cap is placed over the upper end of the pouring spout body. The pouring spout has a blade which is provided at the lower edge of said inner spout for tearing the film adhered over the hole in the container body.

BRIEF DESCRIPTION OF THE DRAWINGS

FIG. 3 is a perspective view showing the structure of a pouring spout according to the present invention.

FIG. 4 is a perspective view showing an inner spout fitted into the pouring spout body according to the present invention.

DETAILED DESCRIPTION OF THE INVENTION

The present invention relates to a container with a pouring spout. The container may be a paper container conveniently used for holding liquids, for example, a gable-top type or flat-top type paper container. Alternatively, it may be a container made of plastic or the like for holding liquids, with the open portion thereof being sealed with a thin plastic film or the like.

The above-mentioned paper containers employ pouring spouts of various types. For example, a "tetrapack" type container has a small hole as an insertion opening covered with a plastic film or an aluminum foil laminated with a plastic film. This covering is easy to tear off and a straw or the like is inserted into the hole. A forked spout has also been utilized, but it is difficult to insert. The pouring spouts now on the market allow liquid to leak near the base of the spout, making resealing impossible, which is one of the defects of such spouts.

It is an object of the present invention to provide a fluid container with a pouring spout wherein the above-mentioned defects are eliminated, the spout is very easy to insert, and the container can be produced at less cost. The present invention will be described with reference to the accompanying drawings.

Figure 1:
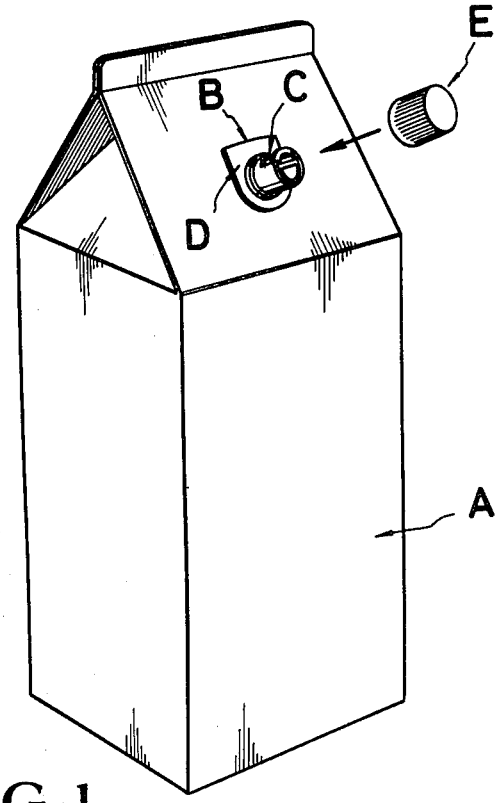
FIG. 1 is a perspective view of a container according to the present invention.
Figure 2:
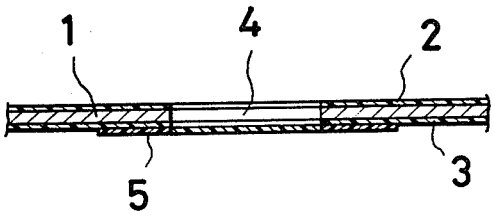
FIG. 2 is a sectional view showing a hole portion of the container according to the present invention.

FIG. 1 is a view schematically showing the outer appearance of a container of the present invention. In this figure, A is a container; B, a pouring means attached at a place to be opened, said pouring means B consisting of an inner spout C and a pouring spout body D; and E, a cap. The container A is made of an intermediate paper layer 1 and has inner and outer surface layers laminated with thermoadhesive plastic films 2 and 3 such as polyethylene and the like. FIG. 2 is a sectional view showing an opening 4 provided at a place to be opened. Numeral 5 denotes a thin thermoadhesive plastic film or an aluminum foil laminated with such a film.

FIG. 3 shows components of the pouring means B, all of which are made of plastic. The inner spout C tightly but slidably fits inside the inner wall of the pouring spout body D, as seen from the schematic view of FIG. 3. The cap E is then placed over the spout body D. The back surface of a flange portion 7 of the pouring spout body D is heated and adhered to the thermoadhesive plastic film 2 at the opening of the container. FIG. 4 is a view showing the outer appearance of the inner spout set within the pouring spout body, which can also be seen in the sectional view of FIG. 5.

The pouring spout body D consists of a cylindrical upright portion 8, outside the lower end of which extends said flange portion 7. A notch portion 9 is provided in the upright portion 8, and a longitudinal groove 10 is provided opposite to the notch portion 9 at the inner surface of the spout body. Projection rings 11 are concentrically provided at the back surface of the flange portion 7. When the flange portion 7 is bonded to a thermoadhesive sheet 2 at the opening of the container, the projection rings 11 are also heated and fuses, so that both parts are rapidly and tightly bonded to each other, simultaneously preventing wrinkles and distortion which may appear with the formation.

Figure 5:
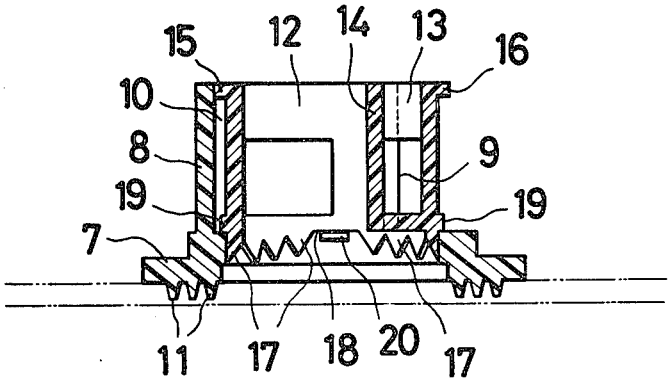
FIG. 5 is a sectional view taken along the line A—A' of FIG. 4.

As shown in FIG. 3, the inner spout C is divided into a pouring channel 12 and an air inlet 13 by an L-shaped wall 14. A projection 15 is provided at the middle of the circular outer periphery of the upper end of the pouring channel 12. An eaves-shaped projecting rim 16 is provided at the circular outer periphery of the air inlet 13. Triangular teeth 17 are provided at the lower edge of the inner spout as a blade for tearing the film at the opening, which is the most characteristic part of this invention. Among these teeth, the longest one may be provided, for example, on the lower edge at a position corresponding to the projection 15. The length of each succeeding tooth is reduced gradually in both directions from this longest tooth. Similar teeth are also provided symmetrically on the opposite side of the inner spout. Alternatively, the longest tooth may be provided at the lower edge at the position corresponding to the projection 15, while, starting from this tooth, teeth gradually decreasing in length are provided in a spiral manner over the whole periphery of the lower edge of the inner spout. However, in either case, one portion 18 having no teeth (untoothed portion) is to be formed. The inner spout thus produced is inserted into the pouring spout body, as seen in FIGS. 4 and 5. In this case, a locking portion 19 provided at the lower outer periphery of the inner spout C engages with a locking portion 20 provided at the lower inner periphery of the pouring spout body D, so that the inner spout C locks with and is held in the cylindrical upright portion 8 of the pouring spout body D.

Figure 6:
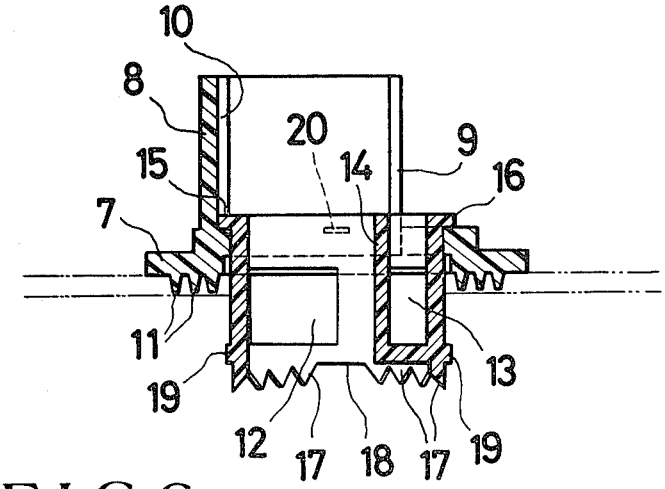
FIG. 6 is a sectional view showing the inner spout of the pouring spout according to the present invention being pressed downwardly to tear the film at the hole portion.
Figure 7:
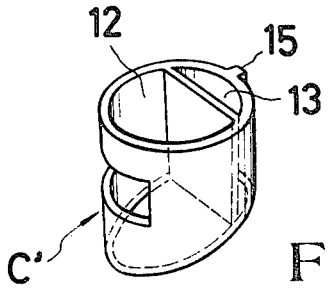
FIG. 7 is a perspective view of another embodiment of the inner spout.

The lower edge of the inner spout C may alternatively be arranged with an inclined edge to form a blade, as shown in FIG. 7. In this case, when the inner spout C is depressed downwardly in the same manner as in the embodiment of FIGS. 5 and 6, the film 5 is torn by the inclined lower edge of the inner spout C.

In order to open the container, the cap E is first removed. When the inner spout is then downwardly depressed, the projection 15 of the inner spout is guided along the groove 10 in the inner wall of the pouring spout body to be moved downwards, and the eaves-shaped projecting rim 16 of the inner spout locks with the lower edge of the notch portion 9 of the pouring spout body to terminate the downward movement, as seen in the sectional view of FIG. 6.

Since the triangular teeth are of different lengths, when the longest tooth presses the film at the opening, the very small contact area will result in an extremely large pressure even if a small overall force is applied. Then the second longest tooth reaches the film to continue tearing it in the same manner as the first tooth, so that the film is torn with a similarly large pressure. Thus, the film is successively torn quite easily. However, it is not cut at the untoothed portion 18. Thus, the film is not completely torn away and therefore does not fall into the container, but rather remains attached at the film portion corresponding to the untoothed portion 18, preventing the film from being accidentally drunk.

As described above, the present invention provides a container with a low cost pouring means which can be easily opened. In the present invention, a hole of a desired size is bored at a part of a container to be opened; a thermoadhesive plastic film or an aluminum foil laminated with such a film is adhered over the hole; an inner spout with a pouring channel and an air inlet is tightly but slidably fitted in a pouring spout which is adhered over the hole with a flange portion extending outside its lower end; a cap is placed over the pouring spout body; and a blade for tearing the film adhered over the hole of the container body is provided at the lower edge of said inner spout.

What is claimed is:

1. A container with a pouring spout, comprising a container body having a hole of a desired size bored in a predetermined part of the container body, an inner surface of said container body being coated with a thermoadhesive plastic film; a seal, including a thermoadhesive plastic film, adhered to said inner surface of said container and covering said hole; a pouring spout body, having a longitudinal groove formed in an inner wall of said pouring spout body, a flange extending radially outwardly from a lower end of said pouring spout body and adhered directly to an outer surface of said container around said hole, and a notch formed in an upper end of said pouring spout body; an inner spout tightly inserted but longitudinally slidable in said inner wall of said pouring spout body, said inner spout including a pouring channel, an air inlet separated from said pouring channel by a wall, a projection slidably received in said longitudinal groove of said pouring spout body, said projection cooperating with said groove to maintain a preselected angular position of said inner spout relative to said container, said angular position being selected such that said air inlet is maintained above said pouring channel during a normal pouring operation, and a rim projecting radially outwardly from said inner spout and slidably received in said notch of said pouring spout body, said rim cooperating with said notch to limit the downward movement of said inner spout relative to said pouring spout body; and a cap placed over said upper end of said pouring spout body.

2. A container with a pouring spout according to claim 1, wherein said inner spout is slidable relative to said pouring spout body between a first position in which said inner spout is positioned above said seal and a second position in which said inner spout extends below said seal, whereby said seal is punctured by said inner spout when said inner spout is in said second position.

3. A container with a pouring spout according to claim 1 or 2, wherein said pouring spout body is adhered directly to said outer surface of said container without being adhered to said seal.

4. A container with a pouring spout according to claim 2, wherein said rim of said inner spout engages a lower closed end of said notch in said pouring spout body when said inner spout is in said second position.

5. A container with a pouring spout according to claim 2, wherein said pouring spout body includes a first locking element extending radially inwardly therefrom and said inner spout includes a second locking element extending radially outwardly therefrom, said first and second locking elements cooperating with each other when said inner spout is in said first position to releasably lock said inner spout in said first position.

6. A container with a pouring spout according to claim 1, wherein said inner spout has a lower end which is provided with a plurality of triangular teeth of gradually varying lengths.

7. A container with a pouring spout according to claim 1, wherein said seal is a thermoadhesive plastic film.

8. A container with a pouring spout according to claim 1, wherein said seal is aluminum foil laminated with a thermoadhesive plastic film.

* * * * *